United States Patent [19]

Sharples

[11] 3,950,116

[45] Apr. 13, 1976

[54] ENGINE HOUSINGS

[75] Inventor: John Sharples, Sandbach, England

[73] Assignee: Rolls-Royce Motors Limited, Crewe, England

[22] Filed: Sept. 4, 1974

[21] Appl. No.: 503,082

[30] Foreign Application Priority Data

Sept. 18, 1973 United Kingdom ..... 43657/73

[52] U.S. Cl. ..... 418/83

[51] Int. Cl.[2] ..... F04C 21/06

[58] Field of Search ..... 418/60, 61 A, 83, 88; 123/8.01, 41.17, 41.79

[56] References Cited

UNITED STATES PATENTS

| | | | |
|---|---|---|---|
| 3,250,260 | 5/1966 | Heydrich | 418/101 X |
| 3,269,372 | 8/1966 | Bonner | 418/83 |
| 3,575,538 | 4/1971 | Berkowitz et al. | 418/83 |
| 3,588,296 | 6/1971 | Toyama et al. | 418/83 |
| 3,644,070 | 2/1972 | Lermusiaux | 418/83 X |

*Primary Examiner*—C. J. Husar
*Assistant Examiner*—Leonard Smith
*Attorney, Agent, or Firm*—Cushman, Darby & Cushman

[57] ABSTRACT

The rotor housing of a rotary piston internal combustion engine has inner, intermediate and outer walls. The inner and intermediate walls are joined by radial webs and define coolant channels and the intermediate and outer walls are joined by non-radial webs between which through bolts extend to join the rotor housing end plates to the housing. The arrangement better absorbs the stresses set up in the housing during engine operation and leads to simpler through bolt installation.

8 Claims, 3 Drawing Figures

ENGINE HOUSINGS

The present invention relates to an engine housing and particularly, but not exclusively, to the housing of a rotary piston internal combustion engine.

Presently known housings of this type comprise a peripheral inner wall which has an internal epitrochoidal surface, joined to an outer peripheral wall by a series of radially extending webs between which a plurality of axially extending coolant channels are defined. The end plates of the housing are retained by through bolts, which may either be of the 'wet' type, passing through the coolant passages and therefore needing good anti-corrosion protection, or the 'dry' type, which pass through separate bosses having sealing rings at their end faces.

In operation of this type of engine, the inner wall is subjected to extremely high pressures and temperatures in the region where the combustion phase of the cycle takes place, and the resulting combination of mechanical and thermal stresses can lead to failure of the webs which connect the inner and outer walls.

According to the present invention, there is provided an engine housing defining a combustion chamber and having a curved internal wall surface wherein the housing comprises inner, outer and intermediate walls, a plurality of webs joining the inner and intermediate walls together and defining a plurality of coolant channels therebetween and a further plurality of webs joining intermediate and outer walls together.

Advantageously, the first mentioned webs extend radially and the second mentioned webs are inclined at an angle to the radial direction.

In a preferred embodiment, in which the housing is a rotor housing for a rotary piston internal combustion engine, the spaces defined between the second mentioned webs are used to accommodate bolts for retaining the end plates.

In order that the invention may be more clearly understood, one embodiment thereof will now be described, by way of example, with reference to the accompanying drawing in which.

Figure 1:
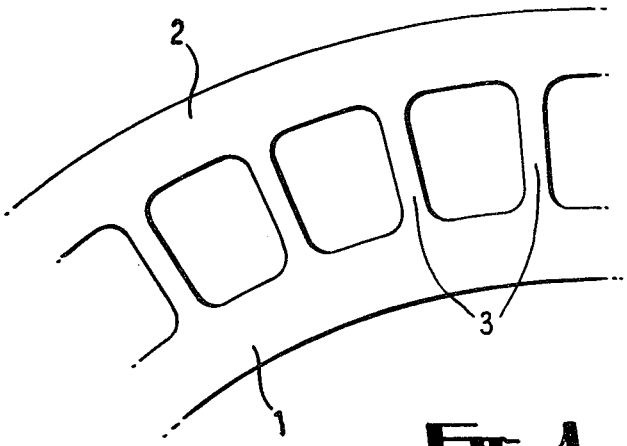
FIG. 1 PRIOR ART
FIG. 1 shows a cross sectional view through a part of a known rotor housing for a rotary piston internal combustion engine.

FIG. 1 is a cross-section through a part of a conventional rotor housing for a rotary piston internal combustion engine. This housing, which is, for example, of cast iron or aluminium, comprises an inner wall 1, having an epitrochoidal internal surface, and an outer wall 2 joined by a series of radially extending webs 3. Where combustion takes place in the combustion chamber defined by the housing, the inner wall becomes very hot and is subjected to very high pressures. The resultant mechanical an thermal stresses can cause failures of the webs 3 usually by tearing at the roots of the webs.

Figure 2:
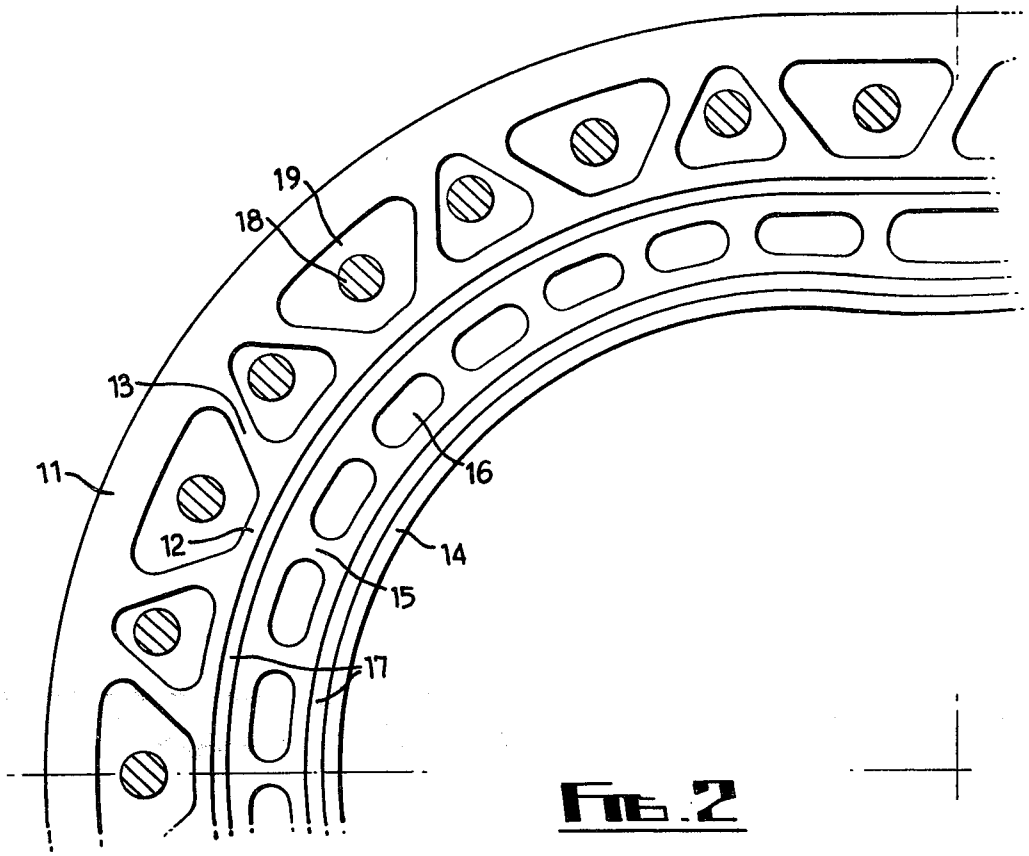
FIG. 2 shows an end elevational view with end plate removed of a part of a rotor housing according to the invention for a rotary piston internal combustion engine, and, FIG. 3 shows an axial cross-sectional view of a modification of the embodiment shown in FIG. 2.

Referring to FIG. 2, the rotor housing according to the invention comprises an inner wall 14 defining an internal epitrochoidal surface and an outer wall 11. Between the two walls there is disposed an intermediate wall 12. The intermediate wall 12 is joined to the inner wall 14 by a series of radially extending webs 15, between which a plurality of coolant channels 16 are defined. Coolant seals 17 are disposed on opposite sides respectively of the plurality of coolant channels. The intermediate wall 12 is connected to the outer wall 11 by webs 13 which extend in a non-radial direction to form a strong outer beam around the inner wall. These webs 13 are equally but oppositely inclined to the radial direction, the angle of inclination being, in this case, approximately 28½°. Channels 19 are defined between these webs 13 and these channels house retaining bolts 18 for the end plates 28 shown in broken lines in FIG. 3 of the rotor housing.

In operation of the engine, the mechanical loads due to the gas pressure on the inner wall 14 are carried through the radial webs 15 to the outer beam (walls 11 and 12 and webs 13), thus relieving the inner wall 14 of some of its load carrying function and allowing it to be made thinner. This enables the cooling to be improved and thermal stresses induced in the inner wall to be reduced. The webs 15 are also better able to withstand the bending loads which can cause failure of the webs in a conventional housing (see FIG. 1) because they are shorter. The combustion chamber pressure and thermal loads only act over a portion of the housing circumference, which as a consequence is subjected to significant transverse shearing loads. The diagonal bracing used in the outer beam is designed to sustain these transverse forces which cannot be resisted satisfactorily by the radial webs employed in the original design.

Figure 3:
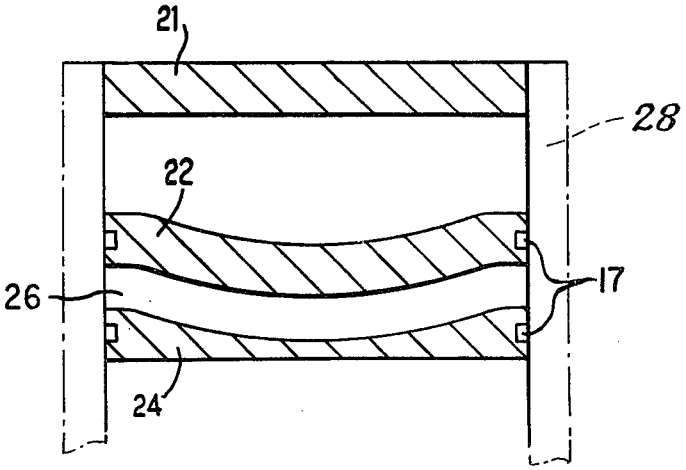

The minimum thickness of the inner wall 14 at its axial ends is determined by the necessity of the wall to accommodate the coolant seals 17. To improve the cooling action, however, the thickness of the inner wall can be decreased along the axial length of the coolant channel as shown in FIG. 3. Thus the inner wall is curved as shown along its radially outer surface and the intermediate wall 22 is curved in a complementary manner.

The coolant channels can also be made radially narrower in this design, which ensures that the whole of the coolant flow is concentrated near to the inner wall. Another improvement in coolant flow is gained from the removal of the through bolts from the coolant passages as described above, giving unobstructed flow. As these bolts are contained in the channels 19, there is no need for either the particularly durable protective finish that a 'wet' bolt system requires, or the individual sealing rings of previous 'dry' bolt designs.

It will be appreciated that the above examples are given, by way of example only, and that many variations are possible without departing from the scope of the invention. The curved channels formed in the embodiment of FIG. 3, for example, can be made parallel to the axis of the housing if it is found necessary to simplify the coring for ease of manufacture, or if a material such as aluminium is used, having a high thermal conductivity but lower strength.

What is claimed is:

1. In an engine housing defining a combustion chamber and having a curved internal wall surface, inner, outer and intermediate walls, a plurality of webs, joining the inner and intermediate walls together and defining a plurality of coolant channels therebetween and a further plurality of webs joining the intermediate and outer walls together, at least some of these further webs extending at an angle of 28½° to the radial direction relative to the local curved internal wall surface.

2. In an engine housing defining a combustion chamber, said engine housing comprising: an inner wall having a curved internal wall surface defining at least a portion of the combustion chamber; an intermediate wall; an outer wall; a plurality of webs joining said inner wall and said intermediate wall together and defining a plurality of coolant channels therebetween; and, a further plurality of webs joining the intermediate wall and the outer wall tigether whereby mechanical loads on the inner wall due to gas pressure in the combustion chamber are transferred from the inner wall to the intermediate wall by the webs joining the same and from the intermediate wall to the outer wall by the webs joining the same, so that the inner wall is relieved of some of its load carrying function and is more efficiently cooled to reduce thermal stresses therein, said further plurality of webs joining the outer and intermediate walls together having at least some of the webs extending in a non-radial direction relative to the local curved internal wall surface.

3. An engine housing as claimed in claim 2, in which at least some of the webs joining the inner and intermediate walls together extend radially relative to the local curved internal wall surface.

4. An engine housing as claimed in claim 2, in which adjacent non-radially extending webs are equally but oppositely inclined to the radial direction.

5. In the rotary piston internal combustion engine, the combination comprising: an engine housing including a housing member and rotor housing end plates connected to opposite ends of the housing member to define a combustion chamber; said housing member including an inner wall having a curved internal wall surface defining at least a portion of the combustion chamber; an intermediate wall; an outer wall; a plurality of webs joining said inner wall and said intermediate wall together and defining a plurality of coolant channels therebetween; and, a further plurality of webs joining the intermediate wall and the outer wall together whereby mechanical loads on the inner wall due to gas pressure in the combustion chamber are transferred from the inner wall to the intermediate wall by the webs joining the same and from the intermediate wall to the outer wall by the webs joining the same, so that the inner wall is relieved of some of its load carrying function and is more efficiently cooled to reduce thermal stresses therein, said further plurality of webs joining the outer and intermediate walls together having at least some of the webs extending in a non-radial direction relative to the local curved internal wall surface; and through bolts extending between the webs joining the outer wall and the intermediate wall, said through bolts connecting the said rotor housing end plates to said housing member.

6. An engine as claimed in claim 5, in which coolant seals are disposed in the axial ends of the intermediate and inner walls.

7. An engine as claimed in claim 5, in which the inner wall thickness varies from a maximum at the ends to a minimum at the centre.

8. An engine as claimed in claim 7, in which the contour of the intermediate wall surface defining the coolant channels follows that of the inner wall surface adjacent the coolant channels.

* * * * *